US009005352B2

(12) United States Patent
Mani et al.

(10) Patent No.: US 9,005,352 B2
(45) Date of Patent: Apr. 14, 2015

(54) TRAP CANISTER FOR ADSORBING FUEL VAPOR

(71) Applicant: Aisan Kogyo Kabushiki Kaisha, Obu-shi, Aichi-ken (JP)

(72) Inventors: Takashi Mani, Hekinan (JP); Ryuji Kosugi, Obu (JP)

(73) Assignee: Aisan Kogyo Kabushiki Kaisha, Obu-Shi, Aichi-Ken (JP)

( * ) Notice: Subject to any disclaimer, the term of this patent is extended or adjusted under 35 U.S.C. 154(b) by 158 days.

(21) Appl. No.: 13/846,374

(22) Filed: Mar. 18, 2013

(65) Prior Publication Data

US 2013/0263741 A1 Oct. 10, 2013

(30) Foreign Application Priority Data

Apr. 6, 2012 (JP) ..... 2012-087070

(51) Int. Cl.
*F02M 25/08* (2006.01)

(52) U.S. Cl.
CPC ..... *F02M 25/0854* (2013.01)

(58) Field of Classification Search
CPC ..... F02M 25/0854
USPC ..... 96/121, 126, 132, 133, 153; 123/519; 95/146
See application file for complete search history.

(56) References Cited

U.S. PATENT DOCUMENTS

| | | | | |
|---|---|---|---|---|
| 5,564,398 | A * | 10/1996 | Maeda et al. | 123/520 |
| 5,692,480 | A * | 12/1997 | Kato et al. | 123/519 |
| 6,230,693 | B1 * | 5/2001 | Meiller et al. | 123/519 |
| 6,874,483 | B2 * | 4/2005 | Zuchara | 123/519 |
| 8,015,965 | B2 * | 9/2011 | Yamasaki | 123/519 |
| 2001/0015134 | A1 * | 8/2001 | Uchino et al. | 96/130 |
| 2004/0173190 | A1 * | 9/2004 | Makino | 123/520 |
| 2005/0014642 | A1 | 1/2005 | Oi et al. | |
| 2011/0214572 | A1 * | 9/2011 | Hasegawa et al. | 96/122 |
| 2012/0186563 | A1 * | 7/2012 | Hasegawa et al. | 123/519 |
| 2013/0000609 | A1 * | 1/2013 | Yamamoto et al. | 123/519 |
| 2013/0186375 | A1 * | 7/2013 | Hasegawa et al. | 123/519 |
| 2013/0263740 | A1 * | 10/2013 | Takashi | 96/112 |

FOREIGN PATENT DOCUMENTS

| | | | |
|---|---|---|---|
| JP | 7151021 | A | 6/1995 |
| JP | 9203353 | A | 8/1997 |
| JP | 2005035812 | A | 2/2005 |
| JP | 2012-127310 | * | 5/2012 |

* cited by examiner

*Primary Examiner* — Frank Lawrence
(74) *Attorney, Agent, or Firm* — Conley Rose, P.C.

(57) ABSTRACT

Embodiments of the invention are directed towards a trap canister for adsorbing fuel vapor contained in breakthrough gas discharged from a main adsorbent canister. The main adsorbent canister is connected to a fuel tank has a case defining an adsorption chamber therein and an adsorbent filled in the adsorption chamber. The case has a first end open to the atmosphere and a second end for introducing breakthrough gas into the adsorption chamber. The adsorbent filled in the adsorption chamber adsorbs the fuel vapor contained in the breakthrough gas. The trap canister further has a bypass path for bypassing the adsorption chamber and a valve configured to block the bypass path and to allow for opening during refueling. This prevents the fuel vapor from flowing into the atmosphere during normal operation while also decreasing pressure loss during refueling.

6 Claims, 4 Drawing Sheets

TRAP CANISTER FOR ADSORBING FUEL VAPOR

This application claims priority to Japanese patent application serial number 2012-087070, the contents of which are incorporated herein by reference.

BACKGROUND OF THE INVENTION

This disclosure relates to a trap canister mounted on a vehicle such as an automobile. In particular, it relates to a trap canister for adsorbing fuel vapor contained in a breakthrough gas discharged from a main canister configured to adsorb the fuel vapor. Here, the term "breakthrough gas" refers to gas discharged from the main canister filled with adsorbent and containing the fuel vapor leaked from the main canister in this disclosure.

In general a conventional trap canister has a hollow case where one end is open to the atmosphere and the other end is configured to introduce the breakthrough gas thereinto. The case therein defines an adsorption chamber filled with an adsorbent capable of adsorbing and desorbing the fuel vapor contained in the breakthrough gas. This breakthrough gas is discharged from a main canister configured to adsorb fuel vapor (see Japanese Laid-Open Patent Publication No. 2005-35812).

With respect to the conventional trap canister, air discharged from the main canister flows through the adsorption chamber in the trap canister during refueling. Since the adsorption chamber of the trap canister is filled with the adsorbent, the trap canister causes airflow resistance and thus high-pressure loss. This results in increased difficulty in refueling. Therefore, there has been a need for improved trap canisters.

BRIEF SUMMARY OF THE INVENTION

In one aspect of the invention, a trap canister is disclosed. The trap canister is used for adsorbing fuel vapor contained in breakthrough gas discharged from a main adsorbent canister. The main adsorbent canister is connected to a fuel tank. A trap canister typically has a case defining an adsorption chamber therein, an adsorbent filled in the adsorption chamber, a bypass path for bypassing the adsorption chamber and a valve configured to block dm bypass path and open during refueling. The case has a first end open to the atmosphere and a second end for introducing breakthrough gas into the adsorption chamber. The adsorbent filled in the adsorption chamber can adsorb and desorb the fuel vapor contained in the breakthrough gas.

According to this aspect, when the valve blocks the bypass path, breakthrough gas is introduced the adsorption chamber and the fuel vapor contained in the breakthrough gas adsorbs into the adsorbent filled in the adsorption chamber. This prevents the fuel vapor from flowing into the atmosphere. During refueling, the valve opens and allows gas-flow through the bypass path. This allows air discharged from the main canister to flow through the bypass pass and into the atmosphere. Therefore, pressure, which is typically lost during refueling, can be retained. This pressure loss typically is caused by airflow resistance in the adsorption chamber.

DETAILED DESCRIPTION OF THE INVENTION

Each of the additional features and teachings disclosed above and below may be utilized separately or in conjunction with other features and teachings to provide improved trap canisters. Representative examples of the present invention, which examples utilized many of these additional features and teachings both separately and in conjunction with one another, will now be described in detail with reference to the attached drawings. This detailed description is merely intended to teach a person of skilled in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

Figure 1:
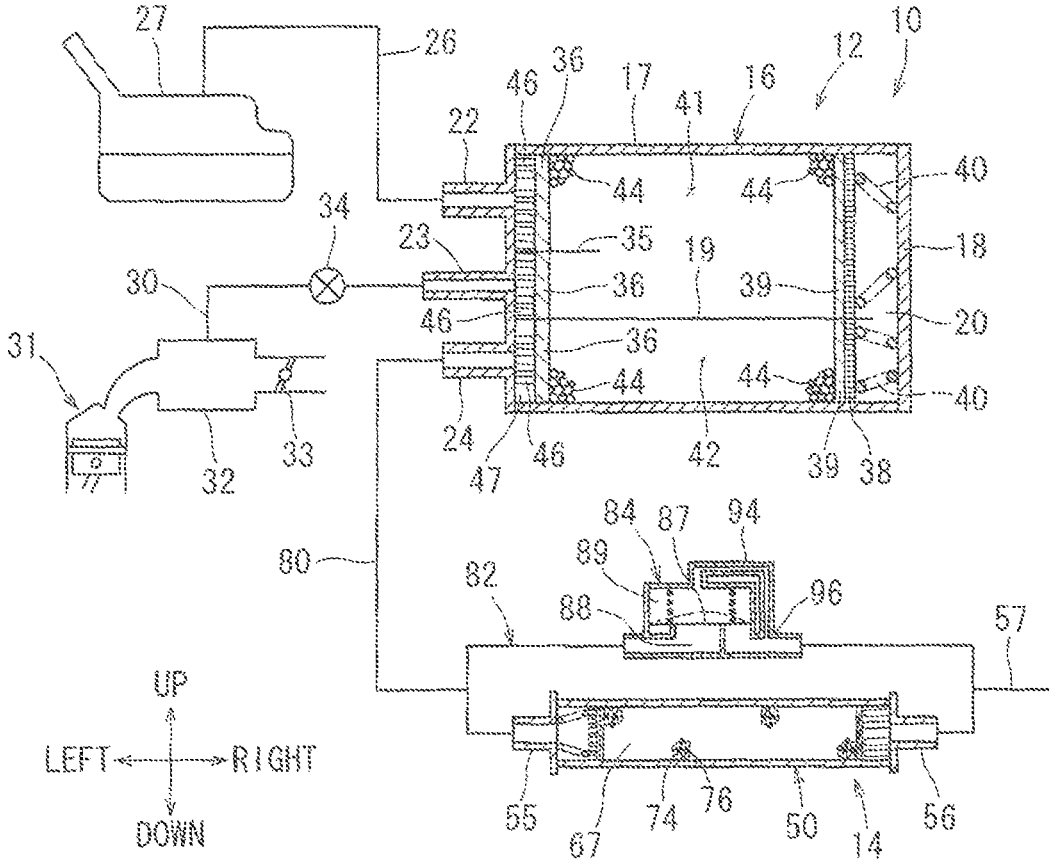
FIG. 1 is a partially sectional schematic view of a fuel vapor recovery system according to a first embodiment.

A first embodiment will be described. In this embodiment, a fuel vapor recovery system mounted on a vehicle such as automobile is exemplified. FIG. 1 is a cross-sectional view showing the fuel vapor recovery system. For convenience of explanation, a vertical direction and a horizontal direction of a main canister and a trap canister are defined based on directions shown in FIG. 1. Here, the trap canister should be mounted on the vehicle such that this vertical direction conforms to the direction of gravitational force.

As shown in FIG. 1, a fuel vapor recovery system 10 has a main canister 12 and a trap canister 14. The main canister 12 has a main case 16. The main case 16 is composed of a main case body 17, which is made from a resin material and is formed in a hollow rectangular column shape having an open top end and a closed bottom end. There is a lid 18 for closing the open top end of the main case body 17. In FIG. 1, the main canister 12 is shown such that a bottom wall of the main case body 17 is positioned on a left side and the lid 18 is positioned on a right side. An inner space of the main case body 17 is divided into an upper chamber and a lower chamber by a partition wall 19. These chambers communicate with each other via a communication chamber 20 formed between the main case body 17 and the lid 18. Thus, the upper chamber, the communication chamber 20 and the lower chamber form a U-shaped gas path. Here, the inner space of the main case body 17 may be divided into two chambers in any direction such that these two chambers communicate with each other.

The bottom wall (left end wall) of the main case body 17 has a tank port 22, a purge port 23 and a connection port 24. The tank port 22 and the purge port 23 communicate with the upper chamber, and the connection port 24 communicates with the lower chamber. The tank port 22 is connected to a fuel tank 27 via a fuel vapor path 26 such that the tank port 22 communicates with a gaseous layer, not a liquid layer, in the fuel tank 27. The purge port 23 is connected with an air intake path 32 of an internal combustion engine (also, referred to as engine) 31 via a purge path 30. The air intake path 32 is provided with a throttle valve 33 for controlling the amount of intake air. The purge path 30 is connected to the air intake path 32 downstream of the throttle valve 33, for example at a surge tank (not shown). The purge path 30 is provided with a purge control valve 34 for opening and closing the purge path 30. While the engine 31 is running, an electric control unit (ECU, not shown) controls the purge control valve 34 in order to carry out purge operation. The connection port 24 is connected to the trap canister 14 via a connection path 80, which is described below.

The upper chamber has a left end area divided into two sections by a dividing wall 35 such that an upper section communicates with the tank port 22 and a lower section communicates with the purge port 23. Filters 36 are provided at left ends of the upper chamber and the lower chamber. Porous plates 38 are provided at open ends (right ends) of the upper chamber and the lower chamber. A filter 39 is placed along an inwardly facing surface (left surface) of each porous plate 38. A spring 40 such as a coil spring is provided between the lid 18 and each porous plate 38. The spring 40 biases the porous plate 38 inwardly, i.e., leftward. In the upper chamber, the filters 36 and 39 define a first adsorption chamber 41 therebetween. In the lower chamber, the filters 36 and 39 define a second adsorption chamber 42 therebetween. The filters 36 and 39 are composed of non-woven cloths made from resin materials, foamed urethane or the like. The bottom wall (left wall) of the main case body 17 has a plurality of pin-shaped projections 46 supporting the filters 36. Accordingly, a space 47 on the port side is defined between the bottom wall (left wall) of the main case body 17 and each filter 39.

The first adsorption chamber 41 and the second adsorption chamber 43 are filled with a granular adsorbent 44 capable of adsorbing and desorbing fuel vapor such as butane. For example, the absorbent 44 may be composed of a granular activated carbon. The granular activated carbon on may be composed of crushed activated carbon or the like. Alternatively, it may be composed of extruded activated carbon formed by mining a granular or powder activated carbon with a binder and extruding it into a cylindrical shape. The adsorbent 44 may be composed of an activated carbon having butane working capacity (BWC) less than 12 g/dL, which is measured by ASTM method.

Figure 2:
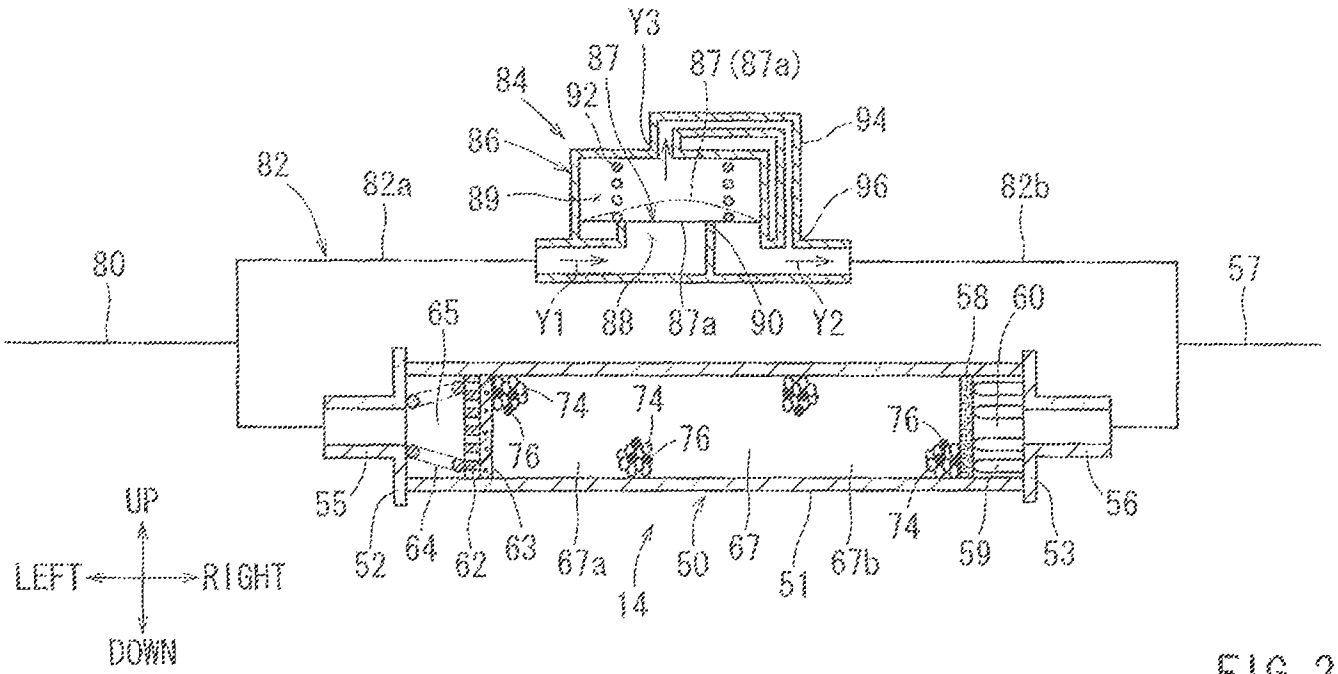
FIG. 2 is a cross-sectional view of a trap canister.

The trap canister 14 will be described. The trap canister 14 is separated from the main canister 12. FIG. 2 is a cross-sectional view of the trap canister 14. The trap canister 14 is mounted on a vehicle such that the vertical direction of the trap canister 14 in FIG. 2 corresponds to the direction of gravitational force. As shown in FIG. 2, the trap canister 14 includes a trap case 50. The trap case 50 is composed of a trap case body 51, which is formed in a hollow cylindrical shape and is made from resin materials. Lids 52 and 53 serve to close both open ends of trap case body 51. An inner space of the trap case body 51 is a gas path extending in an axial direction of the trap canister 14 (horizontal direction in FIG. 2). The left lid 52 concentrically has a connection port 55 communicating with the inner space of the trap case body 51. The connection port 55 is connected with the connection path 80. The right lid 53 concentrically has an air communication port 56 communicating with the inner space of the trap case body 51. The air communication port 56 is open to the atmosphere via an air communication path 57.

A filter 58 is placed at the right open end of the trap case body 51. The filter 58 is preferably made of a non-woven cloth or the like. The lid 53 has at its inwardly facing surface (left surface) a plurality of pin-shaped protections 59 supporting the filter 58. Thus, a space 60 on the air communication port 56 side is defined between the right lid 53 and the filter 58. A porous plate 62 is provided at the left open end of the trap case body 51. A filter 63 is placed along an inwardly facing surface (right surface) of the porous plate 62. The filter 63 is made of foamed urethane or the like. A spring 64 such as a coil spring is provided between the porous plate 62 and the left lid 52. The spring 64 biases the porous plate 62 to the right. Due to this configuration a space 65 on the connection port 55 side is defined between the left lid 52 and the porous plate 62. In an inner space of the trap case body 51, the filters 58 and 63 define an adsorption chamber 67 therebetween.

The adsorption chamber 67 is filled with a mixture of a granular adsorbent 74 capable of adsorbing and desorbing fuel vapor such as butane and a granular heat storage material 76 for suppressing temperature changes of the adsorbent 74 by adjusting its latent heat. The adsorbent 74 may be made of a granular activated carbon. The granular activated carbon may be a crushed activated carbon, an extruded activated carbon formed by mixing a powder or granular activated carbon with a binder and extruding it into a cylindrical shape, or the like. The adsorbent 74 is preferably composed of an activated carbon having BWC equal to or higher than 13 g/dL, also referred to as activated carbon having high adsorption capacity. Activated carbon having high adsorption capacity is typically used for the adsorbent 74. It has high BWC and a large number of small pores compared with standard activated carbon (for example, an activated carbon having BWC less than 12 g/dL). In this way, intermolecular forces between the high adsorption capacity activated carbon and remaining fuel vapor is stronger than that between standard activated carbon and remaining fuel vapor. Thus, the amount of fuel vapor diffusing can be decreased, and thus the amount of fuel vapor flowing out of the trap canister 14 can be decreased. Accordingly, the adsorbent 74 is preferably composed of an activated carbon having BWC equal to or higher than 15 g/dL, more preferably equal to or higher than 17 g/dL. The absorbent 74 has a higher BWC than the granular absorbent 44 in the the second adsorption chamber 42. The second adsorption chamber 42 is an adsorption chamber near a gas outlet of the main canister 12. In this disclosure, the adsorption chamber near the gas outlet of the main canister 12 refers to the second adsorption chamber 42 near the connection port 24 (the outlet for the breakthrough gas) of the main canister 12. It is in this adsorption chamber in which the granular adsorbent is filled.

The heat storage material 76 contains a phase-change material absorbing and releasing latent heat. It may be composed of a phase-change material, a microcapsule enclosing a phase-change material, a pellet enclosing a microcapsule or phase-change material, or the like. For example, paraffin such as heptadecane having the melting point of 22° C. or octadecane having the melting point of 28° C. can be used as the phase-change material. By using latent heat of the heat storage material 76, it is able to suppress a temperature increase in the adsorbent 74. In order to facilitate fuel vapor adsorption, suppression occurs during adsorption of the fuel vapor. It is also able to suppress a temperature decrease in the adsorbent 74 during desorbing fuel vapor in order to facilitate fuel vapor desorption. Here, the heat storage material 76 corresponds to a temperature control means.

As shown in FIG. 1, the connection port 55 of the trap canister 14 is connected to the connection port 24 of the main canister 12 via the connection path 80. FIG. 2 shows an embodiment of an adsorption chamber 67. The half near the connection port 55 of the trap case body 51 is referred to as gas introduction section 67*a* while the other half is referred to as air communication section 67*b*. In this disclosure, the connection port 24 of the main canister 12 corresponds to a breakthrough gas outlet port. And, the connection port 55 of the trap canister 14 corresponds to a gas introduction port.

In this way, intermolecular forces between the high adsorption capacity activated carbon and remaining fuel vapor is stronger than that between standard activated carbon and remaining fuel vapor. Thus, the amount of fuel vapor diffusing can be decreased, and thus the amount of fuel vapor flowing out of the trap canister 14 can be decreased. Accordingly, the adsorbent 74 is preferably composed of an activated carbon having BWC equal to or higher than 15 g/dL, more preferably equal to or higher than 17 g/dL. The adsorbent 74 has a higher BWC than the granular adsorbent 44 in the the second adsorption chamber 42. The second adsorption chamber 42 is an adsorption chamber near a gas outlet of the main canister 12. In this disclosure, the adsorption chamber near the gas outlet of the main canister 12 refers to the second adsorption chamber 42 near the connection port 24 (the outlet for the breakthrough gas) of the main canister 12. It is in this adsorption chamber in which the granular adsorbent is filled.

The heat storage material 76 contains a phase-change material absorbing and releasing latent heat. It may be composed of a phase-change material, a microcapsule enclosing a phase-change material, a pellet enclosing a microcapsule or phase-change material, or the like. For example, paraffin such as heptadecane having the melting point of 22° C. or octadecane having the melting point of 28° C. can be used as the phase-change material. By using latent heat of the heat storage material 76, it is able to suppress a temperature increase in the adsorbent 74. In order to facilitate fuel vapor adsorption, suppression occurs during adsorption of the fuel vapor. It is also able to suppress a temperature decrease in the adsorbent 74 during desorbing fuel vapor in order to facilitate fuel vapor desorption. Here, the heat storage material 76 corresponds to a temperature control means.

As shown in FIG. 1, the connection port 55 of the trap canister 14 is connected to the connection port 24 of the main canister 12 via the connection path 80. FIG. 2 shows an embodiment of an adsorption chamber 67. The half near the connection port 55 of the trap case body 51 is referred to as gas introduction section 67*a* while the other half is referred to as air communication section 67*b*. In this disclosure, the connection port 24 of the main canister 12 corresponds to a breakthrough gas outlet port. And, the connection port 55 of the trap canister 14 corresponds to a gas introduction port. causes the diaphragm valve 84 to block the bypass path 82. When this occurs, the valve portion 87*a* of the diaphragm 87 contacts the valve seat 90. During parking, fuel vapor containing gas composed of fuel vapor in the fuel tank 27 and air is introduced into the first adsorption chamber 41 via the tank port 22 of the main canister 12. The fuel vapor containing gas flows through the first adsorption chamber 41, the communication chamber 20 and the second adsorption chamber 42 in sequence. When flowing through these chambers, the fuel vapor adsorbs onto the adsorbent 44 filled in the first adsorption chamber 41 and the second adsorption chamber 42. Then, breakthrough gas discharged from the main canister 12 is introduced into the trap canister 14 via the connection path 80. When the breakthrough gas floes through the adsorption chamber 67 of the trap canister 14, the fuel vapor contained in the breakthrough gas adsorbs onto the adsorbent 74 filled in the adsorption chamber 67. Adsorption of the fuel vapor causes a temperature increase in the adsorbent 74. Heat storage material 76 filled in the adsorption chamber 67 uses latent heat to facilitate fuel vapor adsorption. In this way, an increase in temperature is suppressed. Eventually, air containing little or no fuel vapor is released into the atmosphere. Such air travels through the air communication port 56 to exit the air communication path 57.

During the purge operation (purge control while the engine 31 is running), the electric control unit (ECU) opens the purge control valve 34. When this occurs, negative pressure generated in the internal combustion engine 31 acts on the first adsorption chamber 41 via the purge port 23 of the main canister 12. Atmospheric air flows through the trap canister 14 and the main canister 12 in an opposite direction to the flow direction of the fuel vapor and the breakthrough gas. Accordingly, fuel vapor is desorbed (purged) from the adsorbent 74 filled in the adsorption chamber 67 of the trap canister 14. At this time, desorption of the fuel vapor causes a temperature decrease of the adsorbent 74. This temperature decrease can be suppressed by using latent heat transfer of the heat storage material 76 in the adsorption chamber 67. The heat storage material 76 facilitates fuel vapor desorption. The mixed gas of the air and the fuel vapor flows out of the trap canister 14 and subsequently into the second adsorption chamber 42 and the first adsorption chamber 41 of the main canister 12. In this way, fuel vapor is desorbed from the adsorbent 44 filled in the first and second adsorption chambers 41 and 42. It then travels from the purge port 23 to the air intake path 32 of the internal combustion engine 31.

During refueling, the fuel vapor in the fuel tank 27 is introduced into the first adsorption chamber 41 via the tank port 22 of the main canister 12. When the fuel vapor flows through the first adsorption chamber 41, the communication chamber 20 and the second adsorption chamber 42, the fuel vapor is absorbed onto the adsorbent 44 in the first adsorption chamber 41 and the second adsorption chamber 42. Since refueling is usually carried out after running the engine 31, i.e., after the purge operation, the adsorbent 44 in the first adsorption chamber 41 and the second adsorption chamber 42 of the main canister 12 can sufficiently adsorb fuel vapor vaporizing in the fuel tank 27. Accordingly, gas discharged from the main canister 12 into the connection path 80 does not contain fuel vapor. In other words, air containing little and preferably no fuel vapor is discharged from the main canister 12.

The air discharged into the connection path 80 flows into the upstream path 82*a* of the bypass path 82 rather than the adsorption chamber 67. This occurs due to the presence of airflow resistance in the adsorption chamber 67. The adsorption chamber 67 is filled with the adsorbent 74. Pressure of the air flowing into the upstream path 82*a* of the bypass path 82 (arrow Y1 in FIG. 2) causes the diaphragm 87 of the diaphragm valve 84 to open. This opening force works against a biasing force of the spring member 92 (see chain double-dashed line 87 in FIG. 2). The valve portion 87*a* of the diaphragm 87 is detached from the valve seal 90. The upstream path 82*a* and the downstream path 82*b* of the bypass path 82 communicate with each other, so that the air flows into the downstream path 82*b* of the bypass path 82. It then flows through the air communication path 57 and into the atmosphere (see arrow Y2 in FIG. 2).

When the air flows through the downstream path 82*b* of the bypass path 82, the narrow portion 96 generates negative pressure in the negative pressure introduction path 94 due to Venturi effect. In this way, negative pressure acts on the back pressure chamber 89 of the diaphragm valve 84 (arrow Y3 in FIG. 3). Accordingly, the diaphragm 87 is sucked toward the back pressure chamber 89, so that valve-opening area of the diaphragm 87, i.e., opening ratio of the diaphragm valve 84 increases. When refueling is stopped, air does not flow into the diaphragm valve 84. Accordingly the diaphragm 87 is pressed against the valve seat 90 due to the biasing force of the spring member 92. This thereby closes the diaphragm valve 84.

In the trap canister 14, the diaphragm valve 84 usually blocks the bypass path 82. During refueling, however, the diaphragm valve 84 allows for communication between the upstream path 82*a* and the downstream path 82*b* in order to allow air to flow through the bypass path 82. Air discharged from the main canister 12 flows through the bypass path 82 (bypassing the adsorption chamber 67) during refueling. This decreases pressure loss during refueling and thus improves ease of refueling.

The narrow portion 96 generates negative pressure by using airflow through the downstream path 82*b* of the bypass path 82 such that the negative pressure acts on the back pressure chamber 89 of the diaphragm valve 84 via the negative pressure introduction path 94. This increases the valve-opening area of the diaphragm valve 84, so that it is able to suppress an increase of pressure loss caused by the diaphragm valve 84 during refueling.

The heat storage material 76 regulating the temperature of the adsorbent 74 is filled in the adsorption chamber 67. Since the heat storage material 76 regulates the temperature of the adsorbent 74, the desorption amount of the fuel vapor can be increased, and the remaining amount of the fuel vapor can be decreased. This decreases the amount of the fuel vapor flowing into the atmosphere. As a result, its DBL (diurnal breathing loss) emission can be improved. This results in improved adsorption and desorption ability for the fuel vapor when ambient temperature is low. In addition, since temperature alteration of the adsorbent 74 can be suppressed using latent heat transfer by the heat storage material 76, the remaining amount of the fuel vapor in the adsorption chamber 67 can be decreased. This results in a decrease in the amount of the fuel vapor flowing into the atmosphere.

The adsorbent 74 has higher adsorption capacity and higher BWC than the adsorbent 44 filled in the adsorption chamber near the gas outlet, i.e., the second adsorption chamber 42 of the main canister 12. If adsorbent 74 having high adsorption capacity is used, the desorption amount of the vapor can be improved and the remaining amount of the fuel vapor in the adsorption chamber 67 can be decreased. This is done by combining the adsorbent 74 with the heat storage material 76. This decreases the amount of the fuel vapor flowing into the atmosphere. As a result, its DBL emission can be decreased.

Figure 3:
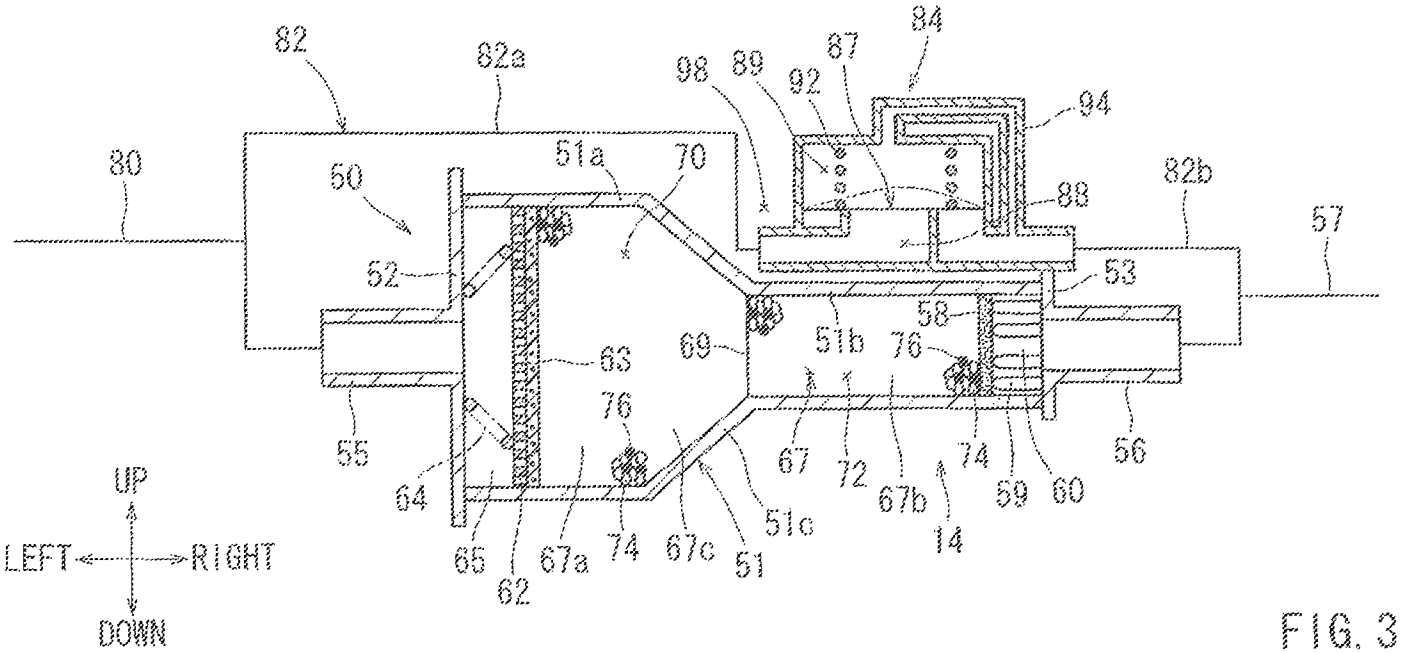
FIG. 3 is a cross-sectional view of a trap canister according to a second embodiment.

Another embodiment will be described. FIG. 3 is a cross-sectional view of the trap canister. As shown in FIG. 3, the shape of the trap case 50 of this embodiment is different from that in the first embodiment. The trap case body 51 of the trap case 50 has a large cylindrical portion 51*a* on the left side and a small cylindrical portion 51*b* on the right side. The large cylindrical portion 51*a* and the small cylindrical portion 51*b* are connected and communicate with each other by a tapered cylindrical portion 51*c* formed in a hollow tapered shape. The tapered cylindrical portion 51*c* defines a path therein such that cross-sectional area of the path gradually decreases along its path length. The large cylindrical portion 51*a*, the small cylindrical portion 51*b*, the tapered cylindrical portion 51*c*, the connection port 55 and the air communication port 56 of the trap case body 51 are concentrically arranged.

A breathable dividing member 69 is placed between the small cylindrical portion 51*b* and the tapered cylindrical portion 51*c* of the trap case body 51 in order to separate an inner space of the large cylindrical portion 51*a* from that of the small cylindrical portion 51*b*. The dividing member 69 is composed of an elastic filter made from a foamed resin such as foamed urethane. The dividing member 69 divides the adsorption chamber 67 into two chambers, i.e., a left large-diameter chamber 70 and a right small-diameter chamber 72. The dividing member 69 may also be omitted in certain embodiments.

The trap case 50 is shaped such that one end is a large cylindrical portion 51*a* having a larger cross-sectional area than the other end being a small cylindrical portion 51*b*. An internal path is formed between the tow end portions. Accordingly, the large cylindrical portion 51*a* and the small cylindrical portion 51*b* form a depressed portion 98 in a stepped shape on an outer surface of the trap case 50. The diaphragm valve 84 is placed in the depressed portion 98, preferably outside of the small cylindrical portion 51*b*.

In this embodiment, the large cylindrical portion 51*a* and the small cylindrical portion 51*b* form the stepped shaped depressed portion 98 outside of the trap case 50. Thus, the diaphragm valve 84 can be placed at the depressed portion 98 outside of the trap case 50 in order to downsize the trap canister 14.

The air communication section 67*b* of the adsorption chamber 67 has a smaller cross-sectional area than the gas introduction section 67*a*. The adsorption/desorption ability of the adsorbent 74 is improved by decreasing the cross-sectional area of the air communication section 67*a*. In addition, although a decrease in the cross-sectional area of the gas introduction section 67*a* causes increase of pressure loss, such pressure loss is suppressed by increasing the cross-sectional area of the gas introduction section 67*b*. Accordingly, it is able to suppress the increase in the pressure loss while decreasing the remaining amount of the fuel vapor. This decreases the amount of the fuel vapor flowing into the atmosphere. That is, increase of the airflow resistance can be suppressed while decreasing DBL emission. In addition, ease of mounting the trap canister 14 on a vehicle can be improved by increasing the cross-sectional area of the gas introduction section 67*a* and decreasing the axial length of the trap case 50.

Because the adsorption chamber 67 has a tapered section 67*c* where its cross-section gradually decreases toward its smaller end, gas can smoothly flow from the gas introduction section 67*a* to the air communication section 67 *b*. This can decrease pressure loss in the absorption chamber 67. Here, the tapered section 67*c* can be omitted.

Figure 4:
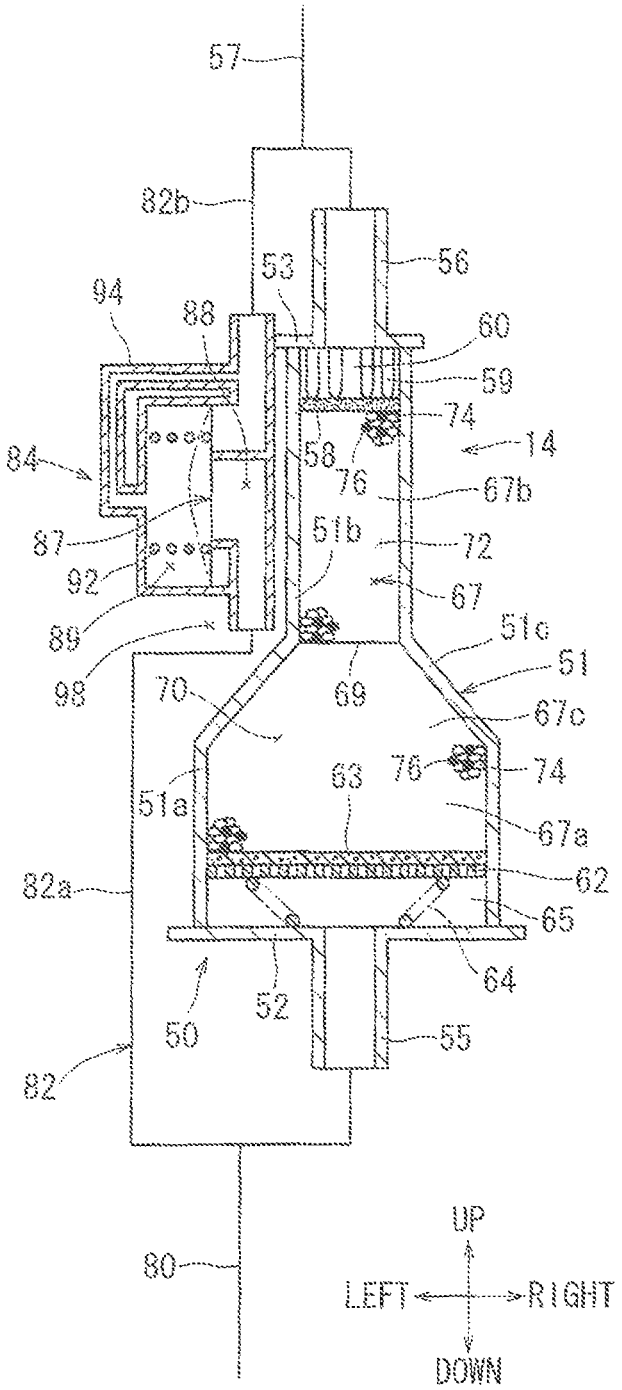
FIG. 4 is a cross-sectional view of a trap canister according to a third embodiment.

Another embodiment will be described. FIG. 4 is a cross-sectional view of the trap canister 14. The trap canister 14 is mounted on a vehicle such that the vertical direction of the trap canister 14 in FIG. 4 corresponds to the direction of gravitational force. In this embodiment, the gas introduction section 67*a* of the adsorption chamber 67 is positioned below the air communication section 67*b*, so that the breakthrough gas containing the fuel vapor should flow upward in the adsorption chamber 67. Due to this configuration, the amount of the fuel vapor flowing into the air communication section 67*b* is decreased and the fuel vapor adsorbing onto the adsorbent 74 filled in the gas introduction section 67*a* can be easily desorbed from the adsorbent 74 by the purge operation. Accordingly, the trap canister 14 has improved adsorption and desorption ability.

The present invention is not limited to the above-described embodiments and can include various modifications without departing from the scope of the invention. For example, the shape of the adsorption chamber 67 of the trap canister 14 is not limited to the cylindrical shape and may be a rectangular column shape. The main case 16 of the main canister 12 can define therein one to more adsorption chamber(s). The adsorbent 74 can be composed of honeycomb-shaped activated carbon instead of granular activated carbon. The heat storage material 76 can be replaced with an electrical heater and can be formed in various shapes instead of granular shape. The diaphragm valve 74 can be replaced with a solenoid valve. The upstream path 82*a* of the bypass path 82 can be connected to the trap case 50 instead of the connection path 80 such that the upstream path 82*a* directly communicates with the space 65. The downstream path 82*b* of the bypass path 82 can be connected to the trap case 50 instead of the air communication path 57 such that the downstream path 82*b* directly communicates with the space 60. The large cylindrical portion 51*a* and the small cylindrical portion 51*b* may be eccentrically connected with each other. Further, the negative pressure introduction path 94 and the narrow portion 96 can be omitted.

The invention claimed is:

1. A trap canister for adsorbing fuel vapor contained in a breakthrough gas discharged from a main adsorbent canister which is connected to a fuel tank, comprising:

a case defining adsorption chamber therein and having a first end open to the atmosphere and a second end for introducing the breakthrough as into the adsorption chamber;

an adsorbent filled in the adsorption chamber and being capable of adsorbing and desorbing the fuel vapor contained in the breakthrough gas;

a bypass path for bypassing the adsorption chamber;

a valve configured to block the bypass path and which is configured to open during refueling; and a negative pressure generator configured to generate negative pressure by using gas flow in the bypass path during refueling;

wherein the valve comprises a diaphragm valve configured to be opened by pressure of the gas flowing through the bypass path and wherein the negative pressure generator communicates with the diaphragm valve in order to cause the negative pressure to act on the diaphragm valve.

2. The trap canister according to claim 1, wherein the adsorption chamber has a larger cross-sectional area at the second end than the first end.

3. The trap canister according to claim 1, further comprising a temperature regulator in the adsorption chamber.

4. The trap canister according to claim 3, wherein the adsorbent is formed in a granular shape.

5. The trap canister according to claim 4, wherein the adsorbent has a higher butane working capacity (BWC) than an adsorbent filled in the main adsorbent canister.

6. The trap canister according to claim 1, wherein the trap canister is configured to be mounted on a vehicle such that the second end of the case is positioned below the first end in the direction of gravitational force.

* * * * *